US006989634B2

(12) United States Patent
Saitou et al.

(10) Patent No.: US 6,989,634 B2
(45) Date of Patent: Jan. 24, 2006

(54) MAGNETRON CATHODE ASSEMBLY

(75) Inventors: Etsuo Saitou, Tochigi (JP); Takeshi Ishii, Tochigi (JP); Masanori Yoshihara, Tochigi (JP); Hideki Ohguri, Tochigi (JP); Toshiyuki Tsukada, Tochigi (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/749,288

(22) Filed: Dec. 30, 2003

(65) Prior Publication Data

US 2005/0062427 A1 Mar. 24, 2005

(30) Foreign Application Priority Data

Sep. 19, 2003 (JP) ..... 2003-327880

(51) Int. Cl.
*H01J 25/50* (2006.01)

(52) U.S. Cl. ..... 315/39.51; 313/38

(58) Field of Classification Search ..... 315/39.51, 315/39.53, 39.67, 39.69, 39.71, 34–38, 42, 315/43; 361/302, 330, 331, 380; 313/34–38, 313/42, 43

See application file for complete search history.

(56) References Cited

U.S. PATENT DOCUMENTS 4,811,161 A * 3/1989 Sasaki et al. ..... 361/302
5,021,713 A * 6/1991 Uesawa et al. ..... 315/39.51
6,696,790 B2 * 2/2004 Murao et al. ..... 315/39.51

FOREIGN PATENT DOCUMENTS

JP 6-73275 3/1994

* cited by examiner

*Primary Examiner*—Wilson Lee
(74) *Attorney, Agent, or Firm*—Pearne & Gordon LLP

(57) ABSTRACT

A magnetron cathode assembly which realizes stopping of turn of an external terminal inserted into a stem insulator without increasing a manufacturing cost. A leading end of a base end axial portion of an external terminal has a non-circular section by providing a flat surface in at least one position on its peripheral surface, and a straight stop edge that fits to the flat surface thereby to carry out stopping of turn of the external terminal is provided for a terminal fitting hole of a sealing metal plate into which the leading end of this external terminal is fitted.

2 Claims, 10 Drawing Sheets

MAGNETRON CATHODE ASSEMBLY

The present invention relates to a cathode assembly of a magnetron used in a microwave heating apparatus such as an electronic oven.

Magnetron used in a microwave heading apparatus usually comprises, as shown in FIG. 6, a vacuum tube 1 located in the center portion, plural heat radiating fins 2 arranged at the periphery of this vacuum tube 1, a pair of annular magnets 3 arranged coaxially with the vacuum tube 1, a pair of frame yokes 4 for connecting these annular magnets 3 magnetically, and a filter circuit portion 5.

Further, the vacuum tube 1 includes a cylindrical anode 6, a cathode assembly 7 arranged on an axis of the cylindrical anode 6, plural plate-like vanes 8 arranged in the inner surface of the cylindrical anode 6 radially extending from a center axis of the cylindrical anode 6, plural strap rings 9 and 10 for electrically connecting these vanes on alternate vanes, and a microwave emission antenna 11 of which one end is connected to any one of the plate-like vanes 8.

The cathode assembly 7, as shown in FIG. 7, includes a metal tube 15 which is joined to one opening end edge of the cylindrical anode 6 coaxially with the cylindrical anode 6 and constitutes a part of the vacuum container, a coil-shaped cathode 17 arranged in the axial portion of the cylindrical anode 6, a pair of cathode terminal lead wires 23 and 24 which support the cathode 17 through end-hats 19 and 20 joined to the leading ends of the cathode 17, a stem insulator 29 which is air-tightly joined to an opening end edge of the metal tube 15 and has a pair of through-holes 29*a* and 29*b* that pass through the stem insulator 29 in the axial direction of the metal tube 15, a pair of external terminals 31 and 32 of which base end axial portions 31*a* and 32*a* are inserted into a pair of through-holes 29*a* and 29*b*, and a pair of sealing metal plates 35 and 36 joined to an end surface on the cathode 17 side of the stem insulator 29.

Leading ends 31*b* and 32*b* of the external terminals 31 and 32 are curved so that the filter circuit portion 5 is easily connected to the external terminals 31 and 32, that is, formed in the shape of a hook.

Of the above parts, the cathode 17 is made of thorium/tungsten, the end-hat 19, 20 and the cathode terminal lead wire 23, 24 are made of molybdenum, the stem insulator 29 is made of ceramic, and the external terminal 31, 32 and the sealing metal plate 35, 36 are made of general conductive metal such as a steel plate.

Each of the sealing metal plates 35 and 36, as shown in FIGS. 8 and 9, includes a terminal fitting hole 35*a*, 36*a* into which the leading end of the base end axial portion 31*a*, 32*a* of the external terminal 31, 32 which extrudes to the metal tube 15*a* side from the stem insulator 29 is fitted; and a lead fitting hole 35*b*, 36*b* into which a leading end of the cathode terminal lead wire 23, 24 is fitted.

In a state where each of the base end axial portions 31*a*, 32*a* and each of the cathode terminal lead wires 23, 24 are fitted respectively into the corresponding terminal fitting hole 35*a*, 36*a* or the corresponding lead fitting hole 35*b*, 36*b*, they are soldered to the sealing metal plates 35 and 36, so that the electric connection between the corresponding external terminal and cathode terminal lead wire is carried out.

Further, the sealing metal plates 35 and 36 are soldered onto a metalized layer formed on the end surface of the stem insulator 29, whereby they are fixed onto the end surface of the stem insulator 29 to seal the end surface on the cathode 17 side of the stem insulator 29 air-tightly.

The reason why the base end axial portions 31*a* and 32*a* that are inserted into the stem insulator 29 are provided for the external terminals 31 and 32 is to suppress the length of the expensive molybdenum-made cathode terminal lead wire 23, 24 to a minimum thereby to reduce cost In the cathode assembly 7, soldering of the cathode terminal lead wires 23, 24 and the external terminals 31, 32 to the sealing metal plates 35, 36 is performed by the following procedure.

Firstly, the cathode terminal lead wires 23, 24, the sealing metal plates 35, 36, the metal tube 15, and the stem insulator 29 are set to a solder reception jig (not shown) that keeps the position of each part shown in FIG. 7. Next, the external terminals 31, 32 are inserted into a pair of through-holes 29*a*, 29*b* of the stem insulator 29 and further into the terminal fitting holes 35*a*, 36*a* of the sealing metal plates 35, 36. Under this state, soldering is executed. At this time, the state among the cathode terminal lead wires 23, 24, the external terminals 31, 32 and the sealing metal plates 35, 36 is as shown in FIG. 8.

Since the base end axial portions 31*a*, 32*a* of the external terminals 31, 32 in the cathode assembly 7 is round rod-shaped, and the terminal fitting holes 35*a*, 36*a* are also round, there is fear that the external terminals 31, 32 turn in soldering and the directions of the leading ends 31*b*, 32*b* are shifted. Therefore, conventionally, as shown in FIGS. 10 and 11, a pair of bulge portions 39*a*, 39*b* are additionally equipped for a top portion of a jig 39 covering the stem insulator 29 in assembly, the leading ends 31*b*, 32*b* of the external terminals 31, 32 are fitted into a groove 39*c* formed by these bulge portions 39*a*, 39*b*, and turning of the leading ends 31*b*, 32*b* is stopped, whereby the directions of the external terminals 31, 32 can be kept constant.

However, in case that turning of the external terminals 31, 32 is stopped by the jig 39 covering the outside of the stem insulator 29, the volume of the jig 39 increases because of equipment of the bulge portions 39*a*, 39*b*, so that quantity of heat in a furnace absorbed by the jig 39 in soldering increases. Consequently, due to a short of heat transmission to each part to be soldered, there is fear that bad joint at the soldering portions is produced.

In order to compensate for the heat absorbed by the jip 39, it is thought that the temperature in the furnace is increased in soldering. However, in this case, consumption of electrical energy increases, and increase of a manufacturing cost is caused.

Because of such the background, as shown in FIGS. 12 and 13, a cathode assembly has been proposed in which the leading ends of the external terminals 31, 32 inserted into the stem insulator 29 include radial direction-extensions 31*c*, 32*c* which extend in the radial direction of the stem insulator 29, and axial direction-extensions 31*d*, 32*d* which extend from the leading ends of these radial direction-extensions 31*c*, 32*c* in the axial direction of the stem insulator 29, and in which on the outer side end surface of the stem insulator 29, grooves 29*c*, 29*d* for housing and retaining the radial direction-extensions 31*c*, 32*c* therein are provided, communicated with each of the through-holes 29*a*, 29*b* (for example, refer to Japanese Postexamined Publication 6-73275).

In the structure shown in FIGS. 12 and 13, components other than the stem insulator 29 and the external terminals 31, 32 are common to those in the cathode assembly 7 shown in FIGS. 6 and 7. Parts common to those in FIGS. 6 and 7 are denoted by the same reference numerals, and their description is omitted.

In the cathode assembly shown in FIGS. 12 and 13, it is prevented, by fitting the radial direction-extensions 31*c*, 32*c* into the grooves 29*c*, 29*d*, that the external terminals 31, 32 inserted into the through-holes 29*a*, 29*b* of the stem insulator 29 turn.

Therefore, it is not necessary to add the bulge portions for preventing the turn of the external terminals 31, 32 to the jig used when the external terminals 31, 32 and the cathode terminal lead wires 23, 24 are soldered to the sealing metal plates 35, 36, and the volume of the jig can be made necessarily minimum, so that the above problems due to the increase of the volume of the jig can be solved.

However, the stem insulator 29 is usually made of ceramic. After ceramic is press-molded with a predetermined molding die, it is fired to form the stem insulator. Generally, in this method, dimensional accuracy is bad. Therefore, it is necessary for the grooves 29*c*, 29*d* to provide a large gap between the external terminals 31, 32 and the grooves 29*c*, 29*d*. Accordingly, there is a problem that accuracy of turning stop of the external terminal 31, 32 becomes bad.

SUMMARY OF THE INVENTION

An object of the invention is, in view of the above problems, to provide a magnetron cathode assembly which can realize stopping of turn of an external terminal inserted into a stem insulator without requiring a jig that causes the increase of a manufacturing cost and improvement of the stem insulator, and which can improve soldering performance of the external terminal and simultaneously can reduce the manufacturing cost.

The above object is achieved by the following constitution.

(1) In a magnetron cathode assembly, a sealing metal plate which includes a terminal fitting hole into which a leading end of an external terminal is fitted, and a lead fitting hole into which a leading end of a cathode terminal lead wire is fitted, thereby to connect electrically the external terminal and the cathode terminal lead wire is joined to a stem insulator. The magnetron cathode assembly is characterized in that the external terminal has a non-circular section by providing a flat surface in at least one position on its peripheral surface, and a stop edge that fits to the flat surface thereby to carry out stopping of turn of the external terminal is provided for the terminal fitting hole.

(2) In the above (1), the magnetron cathode assembly is characterized in that the flat surface of the external terminal that comes into contact with the stop edge of the terminal fitting hole is formed into a slant surface in which the contact strengthens more as fitting into the terminal fitting hole becomes deeper.

In the magnetron cathode assembly described in the above (1), when the leading end of the external terminal is fitted into the terminal fitting hole of the sealing metal plate, the flat surface provided for the leading end of the external terminal is fitted to the stop edge of the terminal fitting hole. By only fitting of the external terminal into the terminal fitting hole, stopping of turn of the external terminal is achieved.

Accordingly, without requiring the jig that causes the increase of a manufacturing cost and improvement of the stem insulator, stopping of turn of the external terminal inserted into the stem insulator can be realized, soldering performance of the external terminal can be improved, and simultaneously the manufacturing cost can be reduced.

In the magnetron cathode assembly described in the above (2), the contact strengthens more as fitting into the terminal fitting hole becomes deeper, which is different from the case in that the flat surface provided for the external terminal is a simple vertical surface in the through-direction of the terminal fitting hole, Therefore, positioning accuracy of fitting improves, and firm fitting in which unstableness is not produced is obtained, so that joint strength by soldering and air-tightly sealing performance can be improved.

DETAILED DESCRIPTION OF THE PREFERRED EMBODIMENTS

The preferred embodiment of a magnetron cathode assembly according to the invention will be described below in detail with reference to drawings.

Figure 1:
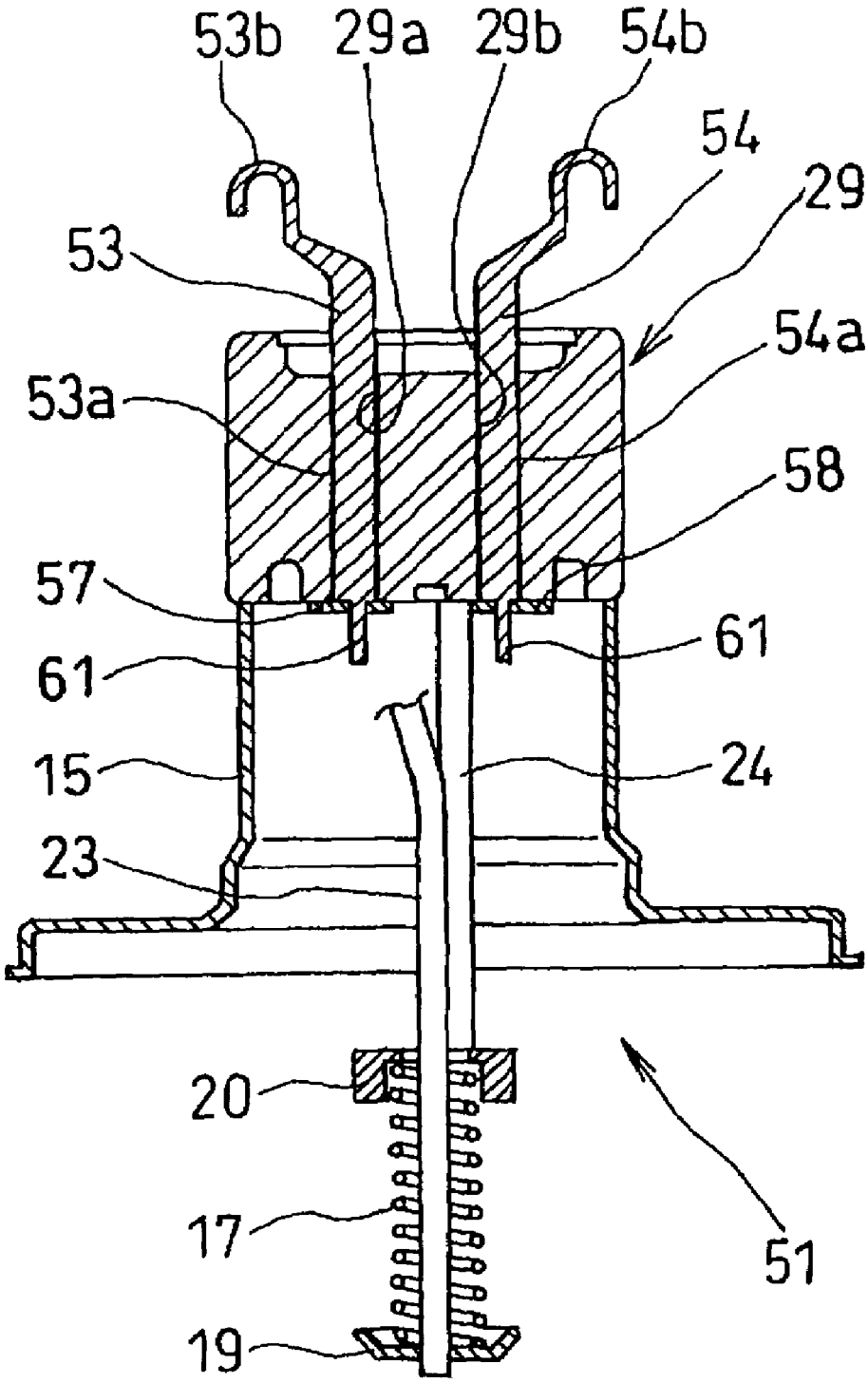
FIG. 1 is a longitudinal sectional view of a magnetron cathode assembly in one embodiment according to the invention.

FIG. 1 shows one embodiment of the magnetron cathode assembly according to the invention.

A magnetron cathode assembly 51 in this embodiment is used for magnetron used in a microwave heating apparatus such as an electronic oven. The magnetron cathode assembly 51 includes a metal tube 15 which is joined to one opening end edge of an anode block coaxially with the anode block and constitutes a part of a vacuum container, a coil-like cathode 17 arranged in the axial portion of the anode block, a pair of cathode terminal lead wires 23 and 24 which support the cathode 17 through end hats 19 and 20 joined to the leading ends of the cathode 17, a stem insulator 29 which is air-tightly joined to an opening end edge of the metal tube 15 and has a pair of through-holes 29*a* and 29*b* that pass through the stem insulator 29 in the axial direction of the metal tube 15, a pair of external terminals 53 and 54 of which base end axial portions 53*a* and 54*a* are inserted into a pair of through-holes 29*a* and 29*b*, and a pair of sealing metal plates 57 and 58 joined to an end surface on the cathode 17 side of the stem insulator 29.

Figure 3:
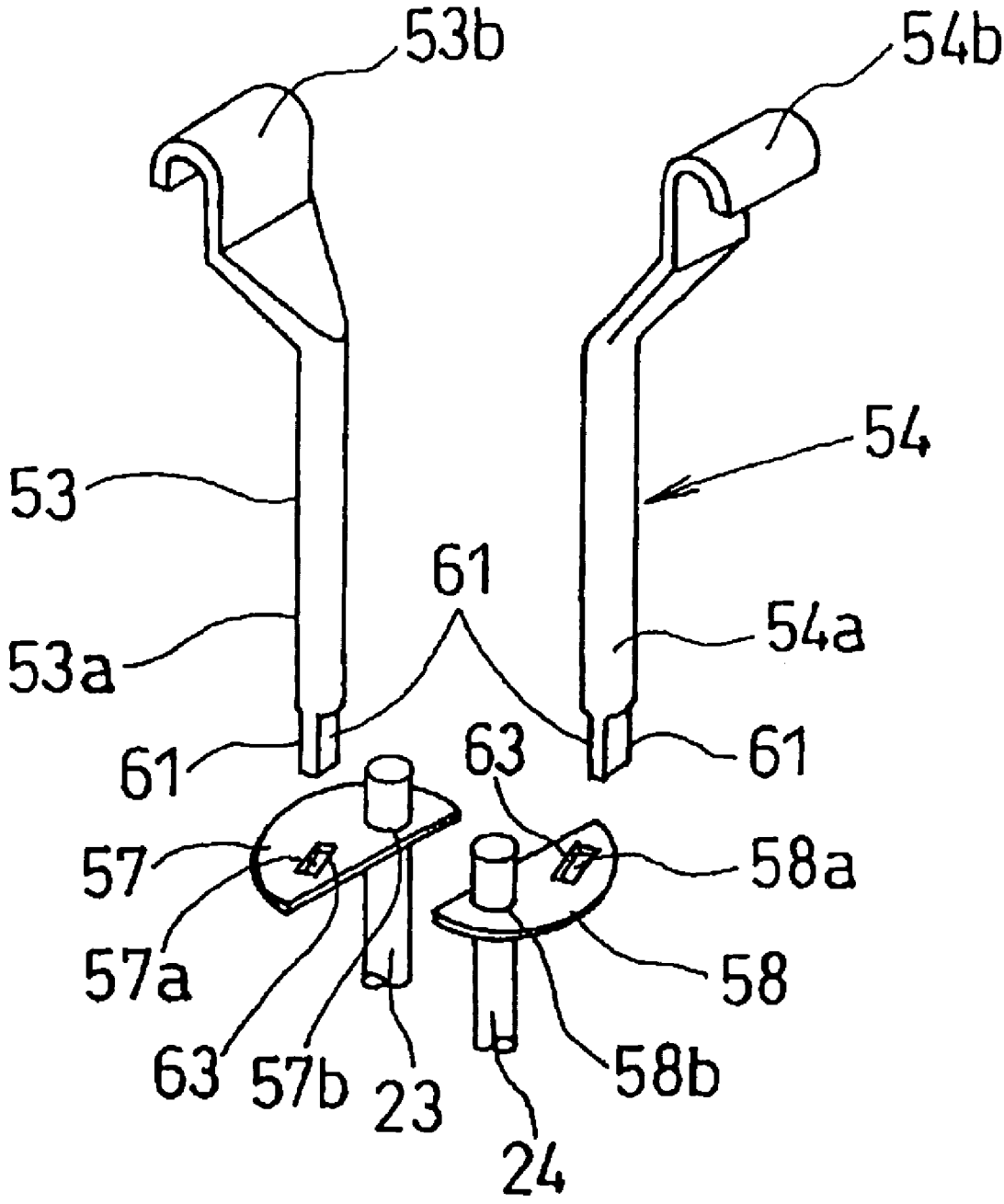
FIG. 3 is an exploded perspective view showing the structure of a fitting portion between each sealing metal plate shown in FIG. 2 and each external terminal.

Leading ends 53*b* and 54*b* of the external terminals 53 and 54 are so curved, as shown also in FIG. 3, that a filter circuit portion is easily connected to the external terminals 53 and 54, that is, formed in the shape of a hook.

Of the above parts, the cathode 17 is made of thorium/tungsten, the end hat 19, 20 and the cathode terminal lead wire 23, 24 are made of molybdenum, the stem insulator 29 is made of ceramic, and the external terminal 53, 54 and the sealing metal plate 57, 58 are made of general conductive metal such as a steel plate.

Figure 7:
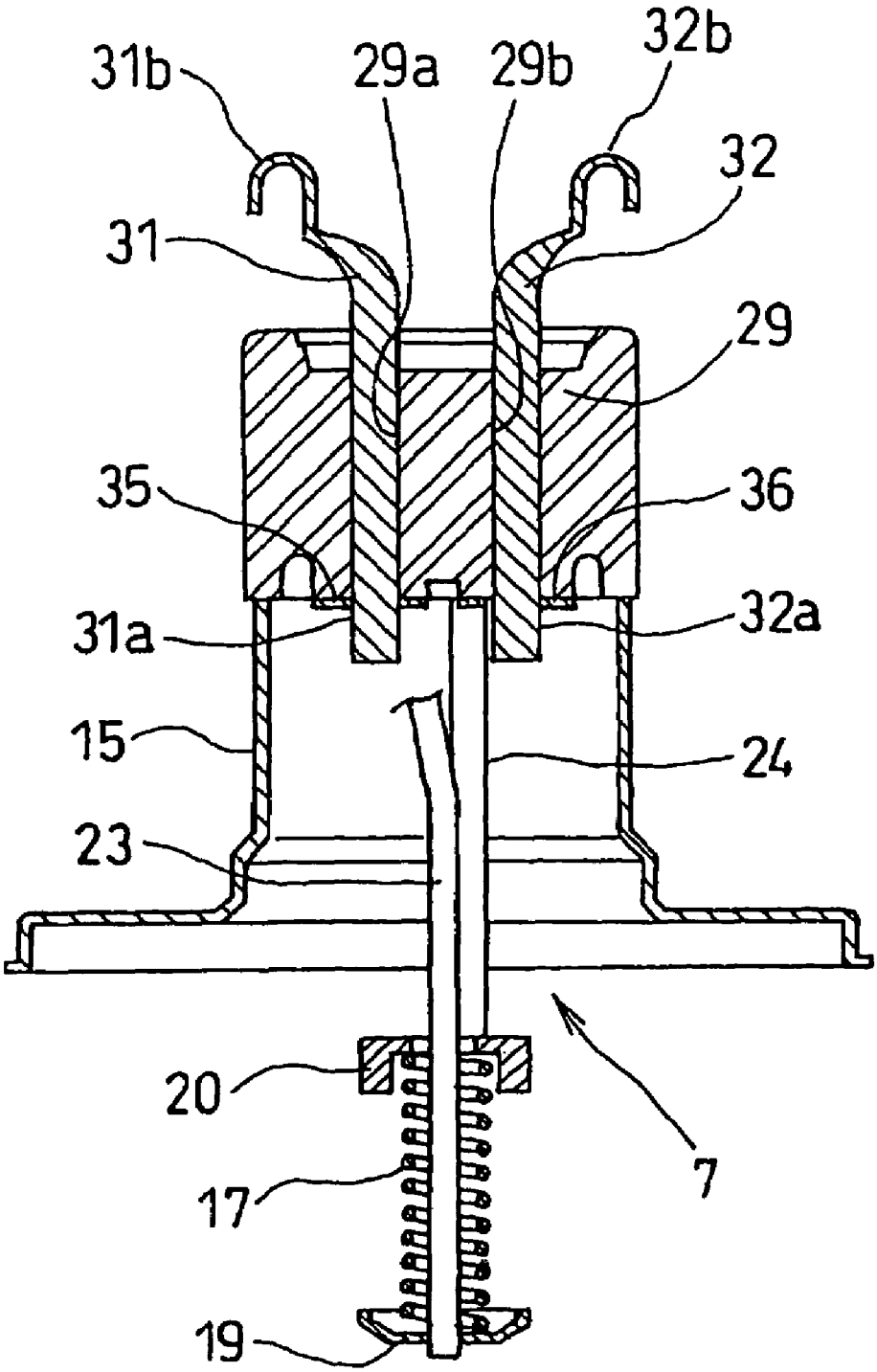
FIG. 7 is an enlarged view of the magnetron cathode assembly shown in FIG. 6, shown in the inverse direction.
Figure 8:
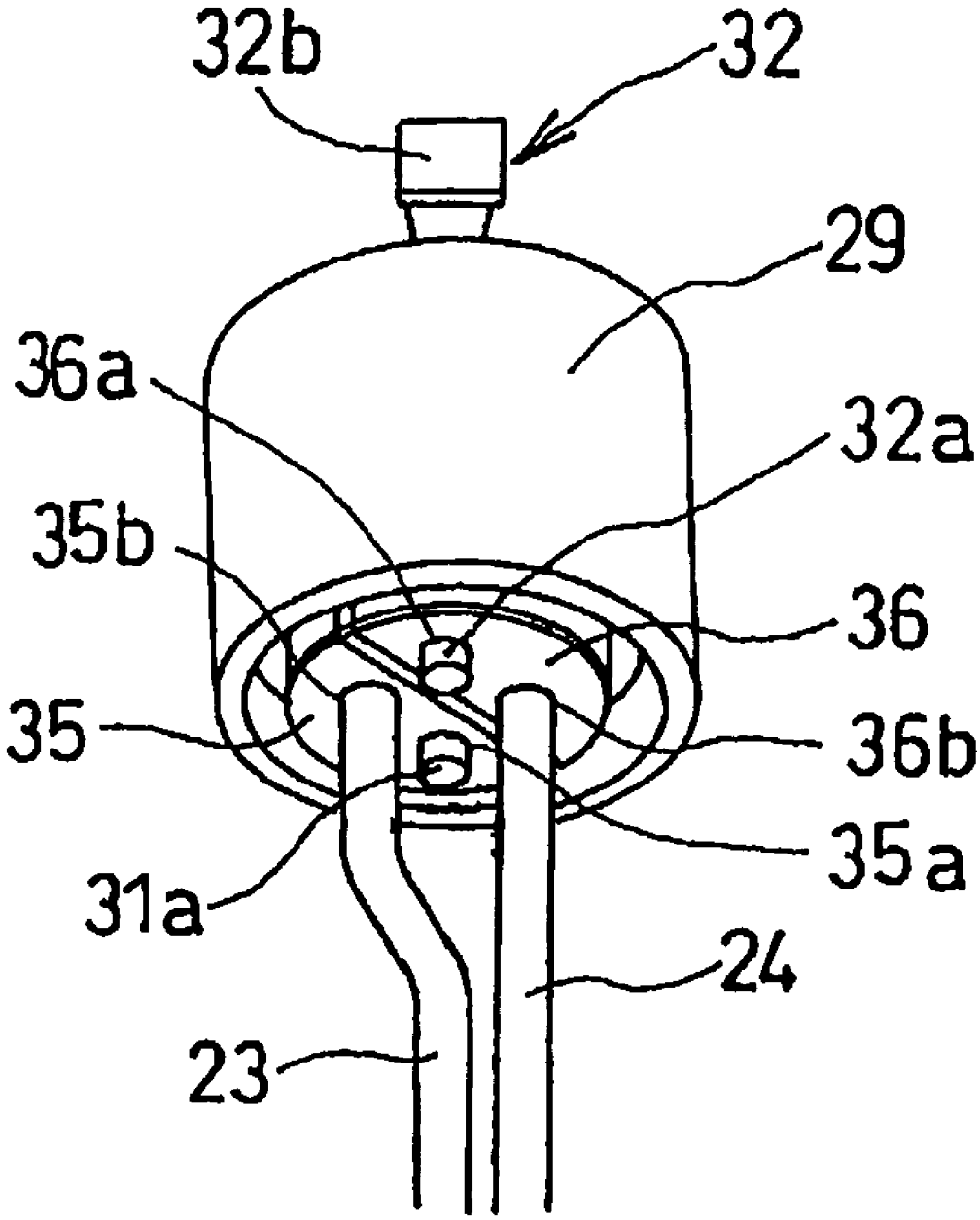
FIG. 8 is a perspective view of the surroundings of the stem insulator shown in FIG. 7.
Figure 9:
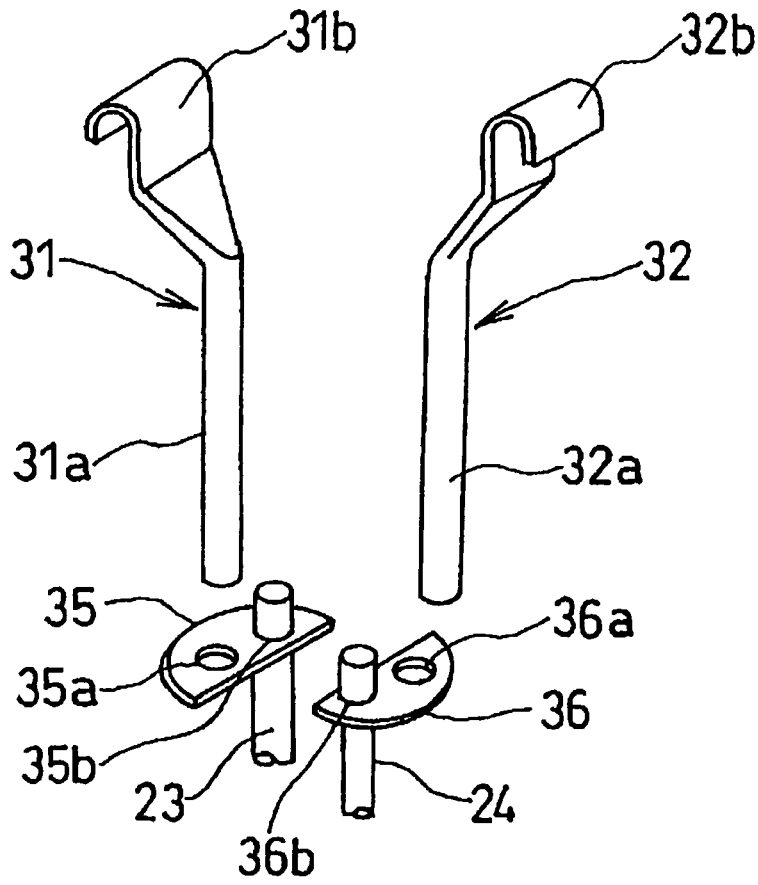
FIG. 9 is an exploded view showing a connecting relation among a cathode terminal lead wire, an external terminal, a sealing metal plate shown in FIG. 6.
Figure 10:
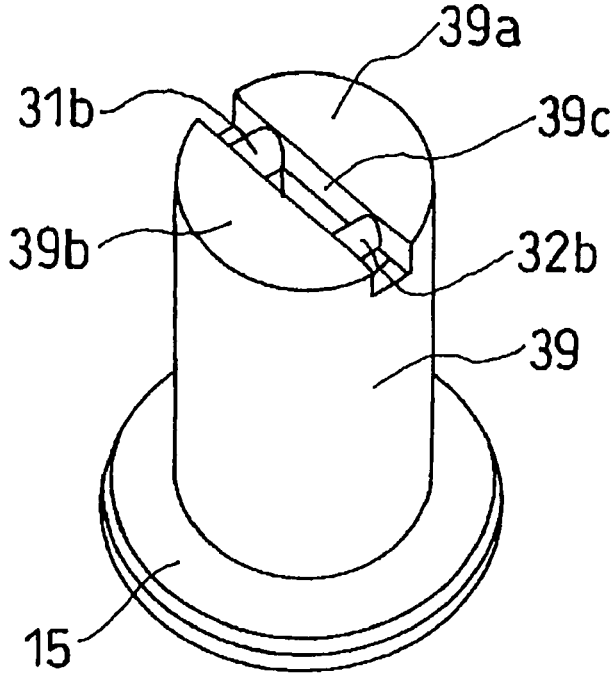
FIG. 10 is a perspective view of a jig used in soldering of the magnetron cathode assembly shown in FIG. 7.
Figure 11:
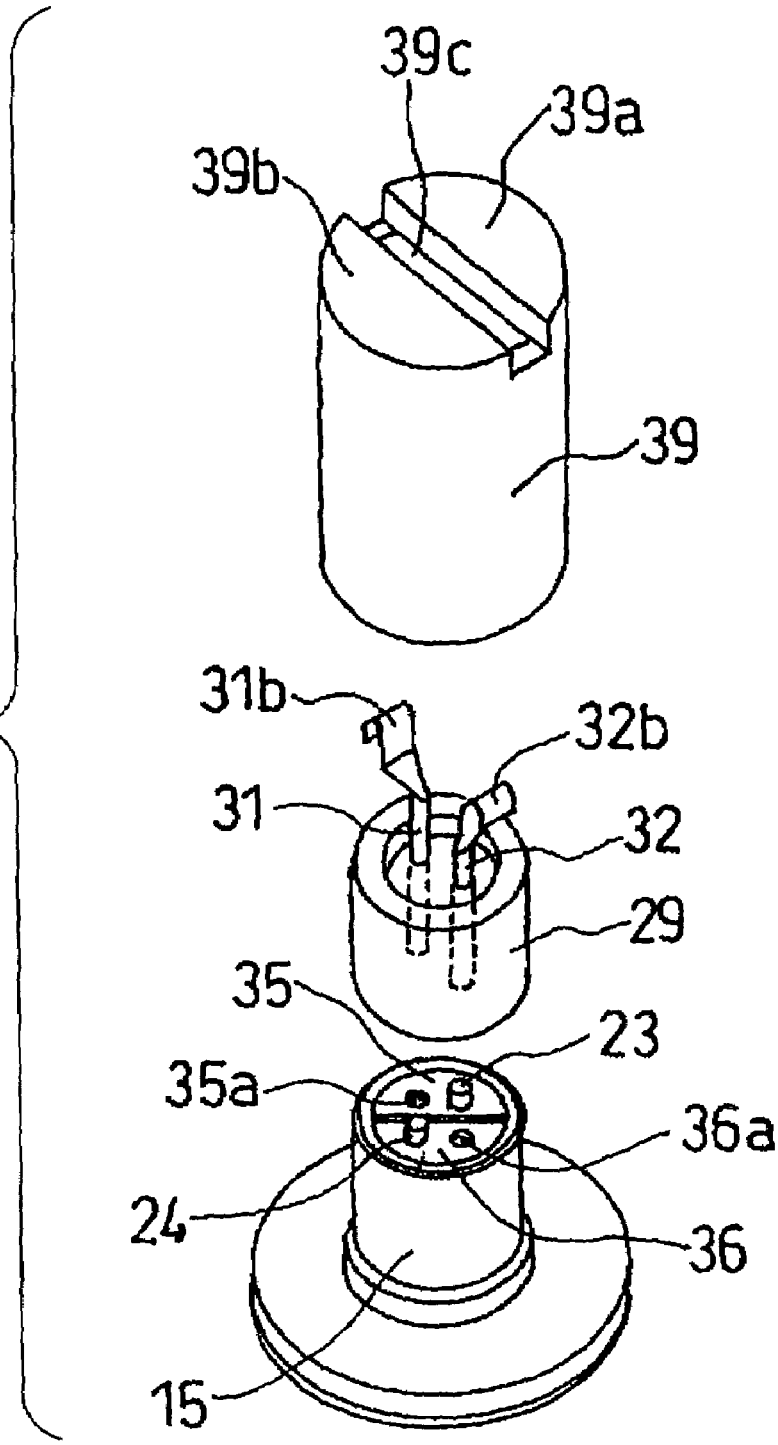
FIG. 11 is a perspective view showing a state where the external terminal is positioned by the jig shown in FIG. 10.
Figure 12:
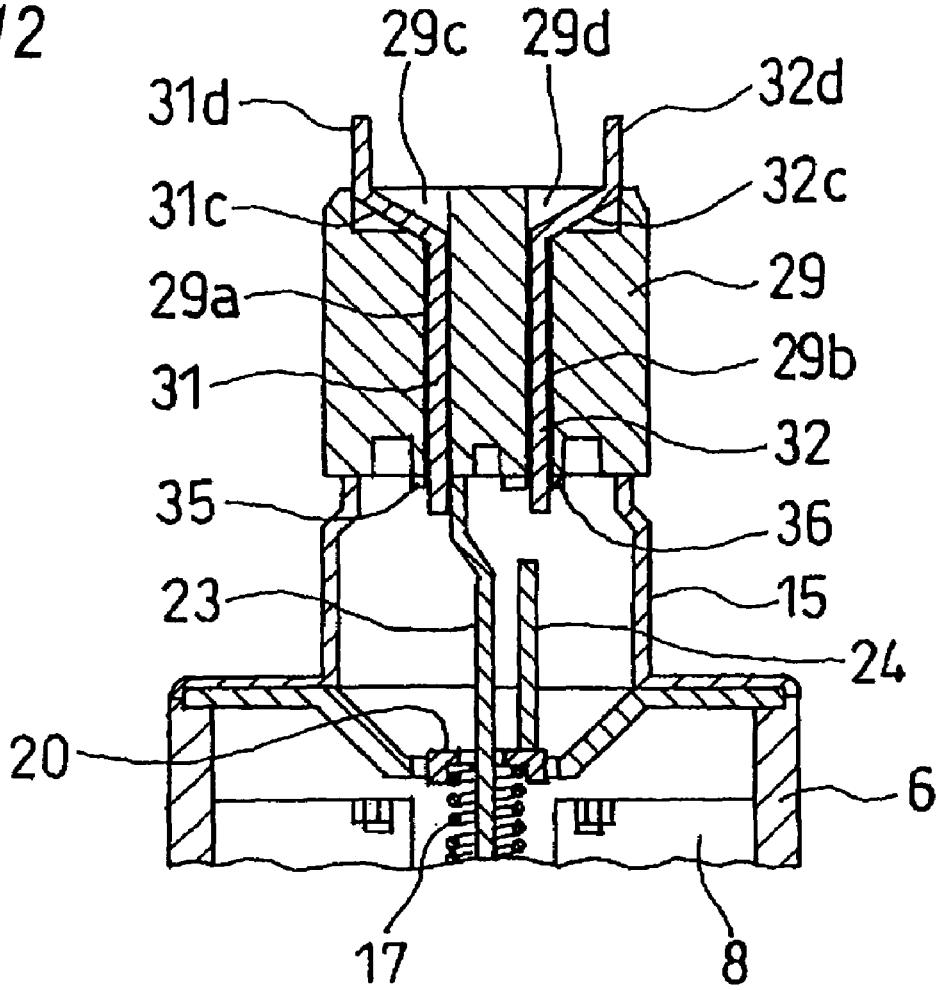
FIG. 12 is a longitudinal sectional view of the conventional magnetron cathode assembly that has been improved.
Figure 13:
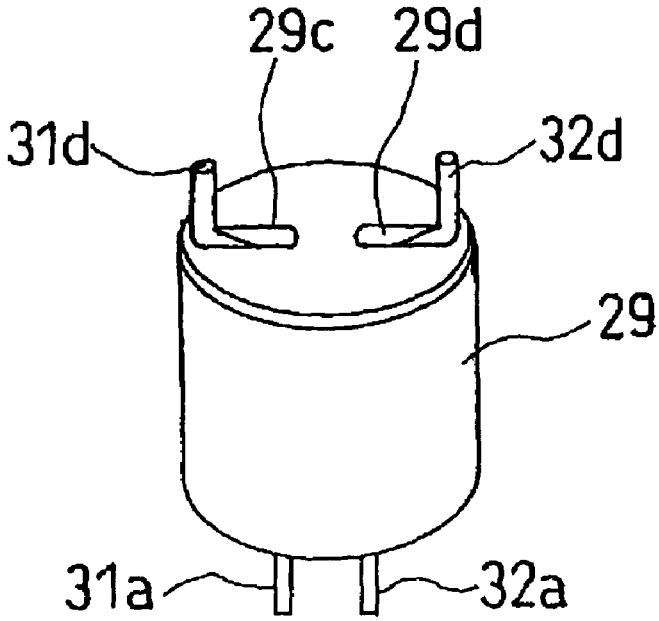
FIG. 13 is a perspective view of the magnetron cathode assembly shown in FIG. 12.

In the magnetron cathode assembly 51 in this embodiment, components other than the external terminals 53, 54 and the sealing metal plate 57, 58 are common to the components in the cathode assembly 7 shown in FIG. 7.

Figure 2:
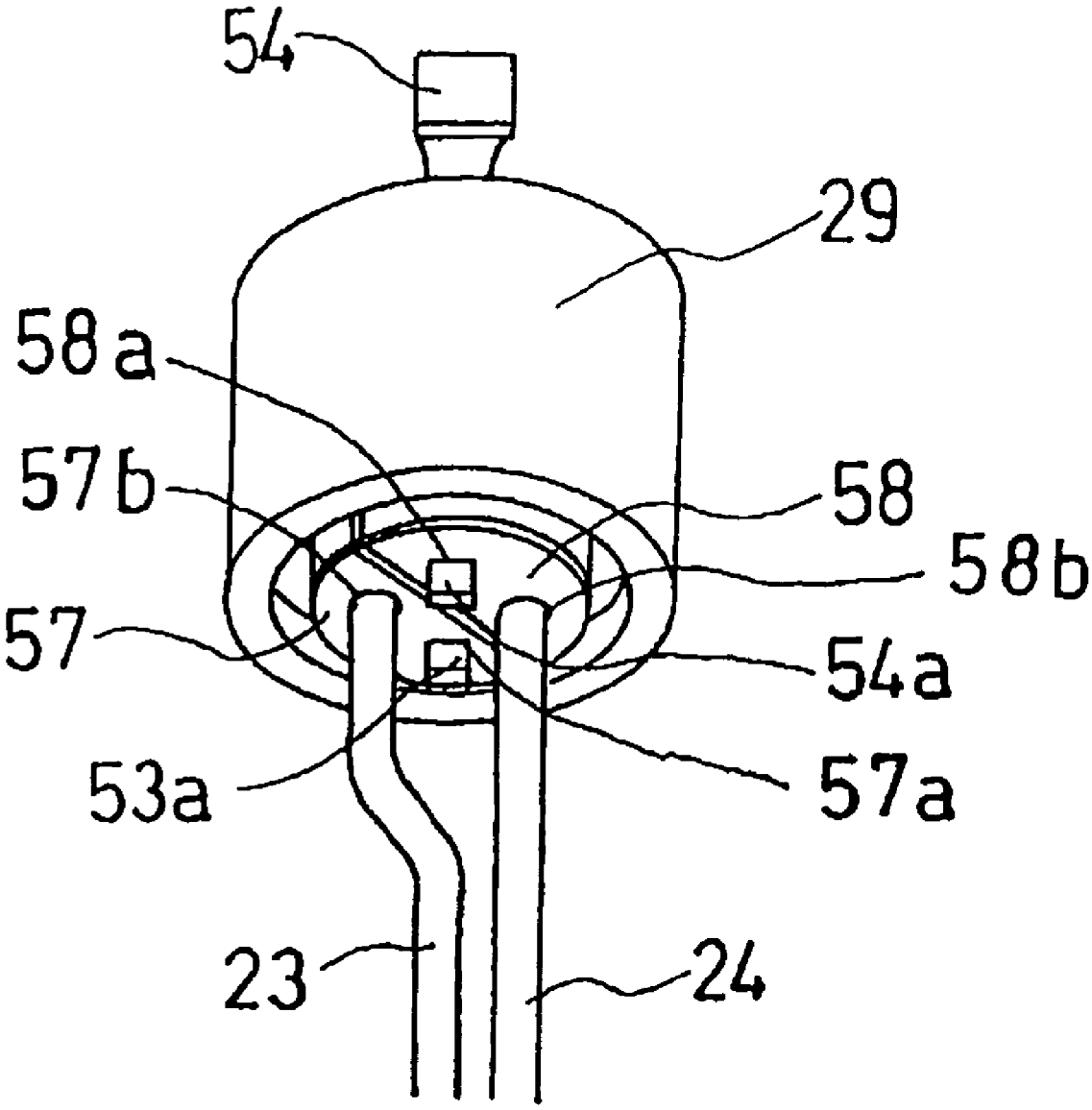
FIG. 2 is a perspective view showing a fitting state between each sealing metal plate located on the cathode-side end surface of a stem insulator shown in FIG. 1 and each external terminal.

Each of the sealing metal plates 57 and 58, as shown in FIGS. 2 and 3, includes a terminal fitting hole 57*a*, 58*a* into which a leading end of the base end axial portion 53*a*, 54*a* of the external terminal 53, 54 which extrudes to the metal tube 15*a* side from the stem insulator 29 is fitted; and a lead fitting hole 57*b*, 58*b* into which a leading end of the cathode terminal lead wire 23, 24 is fitted.

In a state where the base end axial portions 53*a*, 54*a* and the cathode terminal lead wires 23, 24 are fitted respectively into the corresponding terminal fitting holes 57*a*, 58*a* or the lead fitting holes 57*b*, 58*b*, they are soldered to the sealing metal plates 57 and 58, so that the electric connection between the corresponding external terminal and cathode terminal lead wire is carried out.

Further, the sealing metal plates 57 and 58 are soldered onto a metallized layer formed on the end surface of the stem insulator 29, whereby they are fixed onto the end surface of the stem insulator 29 to seal the end surface on the cathode 17 side of the stem insulator 29 air-tightly.

The reason why the base end axial portions 53*a* and 54*a* that are inserted into the stem insulator 29 are provided for the external terminals 53 and 54 is to suppress the length of the expensive molybdenum-made cathode terminal lead wire 23, 24 to a minimum thereby to reduce cost In case of this embodiment, the base end axial portion 53*a*, 54*a* fitted into the terminal fitting hole 57*a*, 58*a* is round rod-shaped. However, the leading end of this base end axial portion 53*a*, 54*a*, as shown also in FIG. 4, has a non-circular section by forming a pair of opposing portions on the peripheral surface into a flat surface 61. It is good for formation of a pair of flat surfaces 61 to utilize press molding that is superior in working performance.

Further, for the terminal fitting hole 57*a*, 58*a* of the sealing metal plate 57, 58, a straight stop edge 63 that carries out stopping of turn of the external terminal 53, 54 is provided.

In case of this embodiment, each of the terminal fitting holes 57*a* and 58*a* has a pair of straight stop edges 63 opposed to each other correspondingly to a pair of flat surfaces 61 provided for the leading end of each external terminal 53, 54. In result, the terminal fitting hole 57*a*, 58*a* shows a rectangular opening shape.

In the above cathode assembly 51, soldering of the cathode terminal lead wire 23, 24 and the external terminal 53, 54 to the sealing metal plate 57, 58 is performed by the following procedure.

Firstly, the cathode terminal lead wires 23, 24, the sealing metal plates 57, 58, the metal tube 15, and the stem insulator 29 are set to a solder reception jig (not shown) that keeps the position of each part shown in FIG. 1. Next, the external terminals 53, 54 are inserted into a pair of through-holes 29*a*, 29*b* of the stem insulator 29 and further into the terminal fitting holes 57*a*, 58*a* of the sealing metal plates 57, 58. Under this state, soldering is executed. At this time, the state among the cathode terminal lead wires 23, 24, the external terminals 53, 54 and the sealing metal plates 57, 58 is as shown in FIG. 2.

In the magnetron cathode assembly 51 described above, when the leading end of the base end axial portion 53*a*, 54*a* protruding from the cathode-side end surface of the stem insulator 29 is fitted into the terminal fitting hole 57*a*, 58*a* of the sealing metal plate 57, 58, the flat surface 61 provided for the leading end of the base end axial portion 53*a*, 54*a* is fitted to the stop edge 63 of the terminal fitting hole 57*a*, 58*a*. By only fitting of the external terminal into the terminal fitting hole 57*a*, 58*a*, stopping of turn of the external terminal inserted into the stem insulator 29 is achieved.

Accordingly, without requiring the jig that causes the increase of a manufacturing cost and improvement of the stem insulator 29, stopping of turn of the external terminal 53, 54 inserted into the stem insulator 29 can be realized, soldering performance of the external terminal 53, 54 can be improved, and simultaneously the manufacturing cost can be reduced.

It is preferable that the flat surface 61 of the external terminal 53, 54 coming into contact with the stop edge 63 of the terminal fitting hole 57*a*, 58*a* has a slant surface 65 in which the contact strengthens more as fitting into the terminal fitting hole 57*a*, 58*a* becomes deeper.

Figure 4:
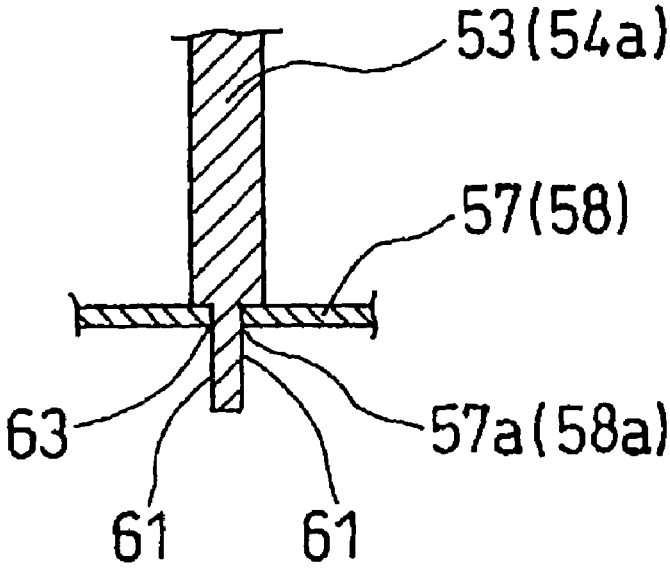
FIG. 4 is an enlarged view of the fitting portion between the sealing metal plate shown in FIG. 1 and the external terminal.
Figure 5:
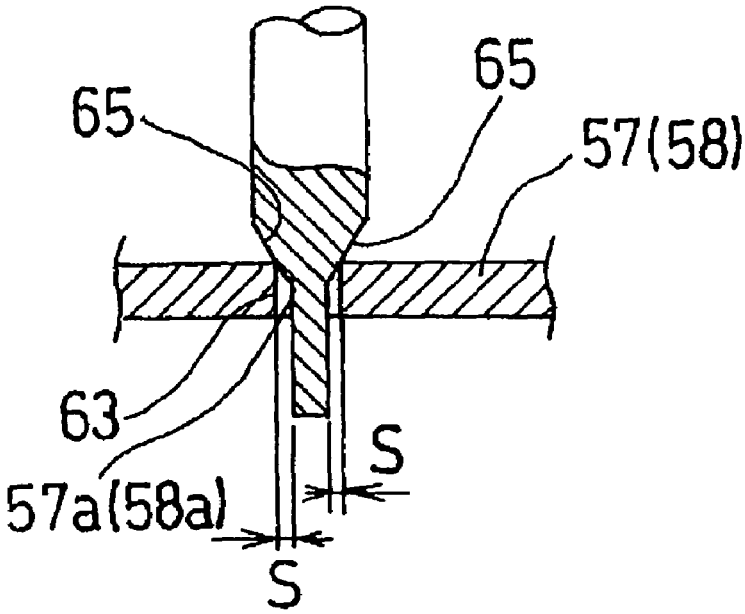
FIG. 5 is a sectional view showing a leading end shape of an external terminal used in another embodiment of the magnetron cathode assembly according to the invention.
Figure 6:
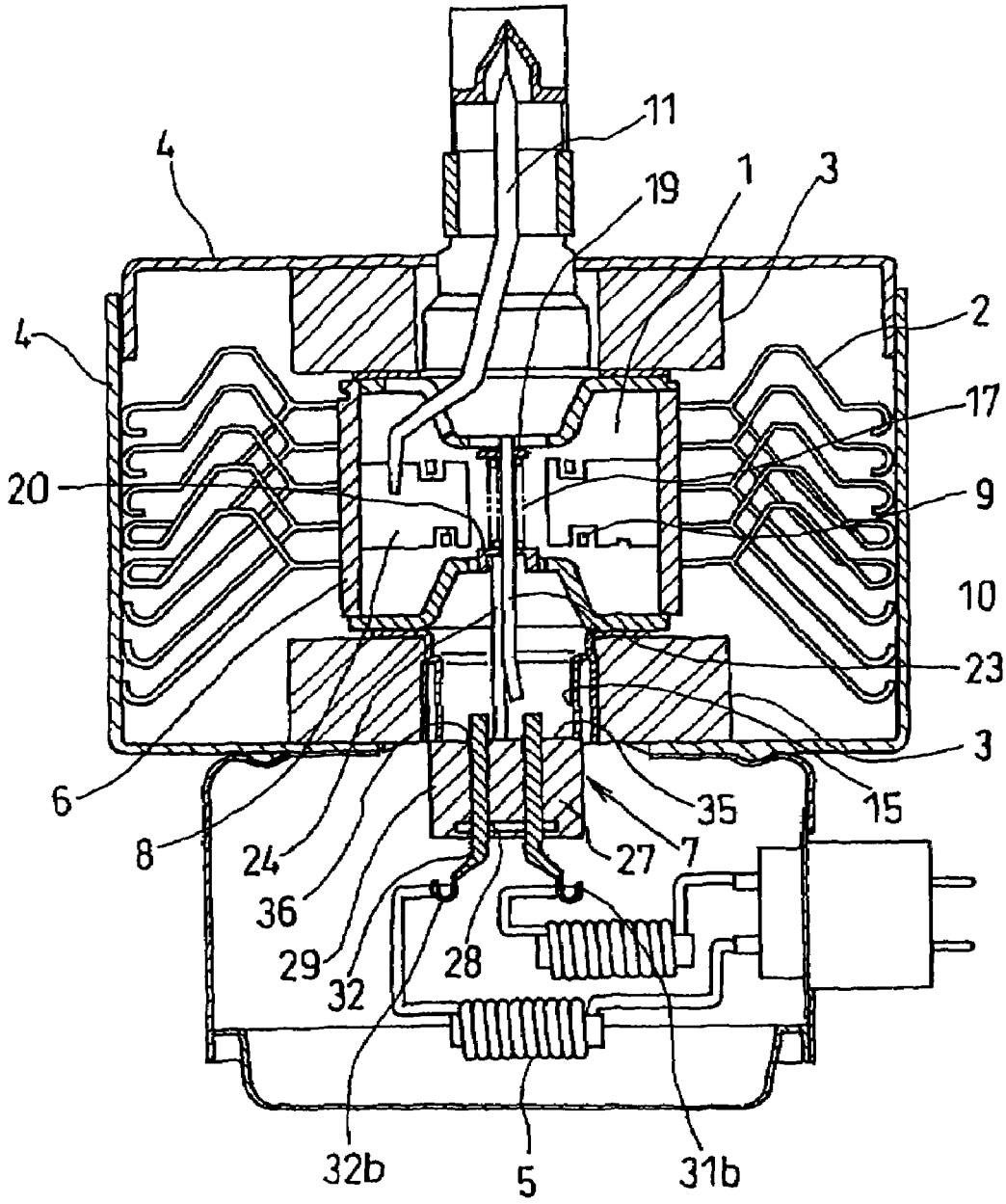
FIG. 6 is a longitudinal sectional view showing the constitution of a conventional magnetron cathode assembly.

This case is different from the case shown in FIG. 4 where the flat surface 61 provided for the leading end of the base end axial portion 53*a*, 54*a* of the external terminal 53, 54 is a simple vertical surface in the through-direction of the terminal fitting hole 57*a*, 58*a*, because the contact strengthens more as fitting of the base end axial portion 53*a*, 54*a* into the terminal fitting hole 57*a*, 58*a* becomes deeper, whereby a gap s is not produced between the slant surface and the flat surface. Therefore, positioning accuracy of fitting improves, and firm fitting in which unstableness is not produced can be obtained, so that joint strength by soldering and air-tightly sealing performance can be improved.

In the above embodiment, at the leading end of the base end axial portion 53*a*, 54*a* of the external terminal 53, 54, the flat surfaces 61 for preventing the turn are formed in two opposing positions. However, it is sufficient that the flat surface 61 for preventing the turn is arranged in at least one position, and the number of the flat surfaces 61 for preventing the turn is not limited to that in the above embodiment.

What is claimed is:

1. A magnetron cathode assembly comprising:

a sealing metal plate including a terminal fitting hole into which a leading end of an external terminal is fitted, and a lead fitting hole into which a leading end of a cathode terminal lead wire is fitted; and a stem insulator which is joined to the sealing metal plate to electrically connect to said external terminal and said cathode terminal lead wire, wherein said external terminal has a non-circular section by providing a flat surface in at least a part on its peripheral surface; and a stop edge that fits to said flat surface thereby to carry out stopping of turn of said external terminal is provided for said terminal fitting hole.

2. A magnetron cathode assembly comprising:

a sealing metal plate including a terminal fitting hole into which a leading end of an external terminal is fitted, and a lead fitting hole into which a leading end of a cathode terminal lead wire is fitted; and a stem insulator which is joined to the sealing metal plate to electrically connect to said external terminal and said cathode terminal lead wire, wherein said external terminal has a non-circular section by providing a flat surface in at least a part on its peripheral surface; and a stop edge that fits to said flat surface thereby to carry out stopping of turn of said external terminal is provided for said terminal fitting hole, wherein the flat surface of said external terminal that comes into contact with the stop edge of said terminal fitting hole is formed into a slant surface in which the contract strengthens more as fitting into the terminal fitting hole becomes deeper.

* * * * *